United States Patent [19]

Morrison et al.

[11] 4,320,901

[45] Mar. 23, 1982

[54] MICROPROCESSOR CONTROLLED GAME

[75] Inventors: Howard J. Morrison, Deerfield; Jeffrey D. Breslow, Highland Park; Rex M. Harper, Chicago, all of Ill.

[73] Assignee: Marvin Glass & Associates, Chicago, Ill.

[21] Appl. No.: 119,749

[22] Filed: Feb. 8, 1980

[51] Int. Cl.[3] ..... A63B 71/04; A63F 9/00

[52] U.S. Cl. ..... 273/237; 273/1 GC; 273/153 R

[58] Field of Search ..... 273/1 GC, 1 GE, 856, 273/1 E, 237, 138, 153; 46/174, 175, 176

[56] References Cited

U.S. PATENT DOCUMENTS

| | | | |
|---|---|---|---|
| 3,494,617 | 2/1970 | Glass et al. | 273/1 GE |
| 4,103,890 | 8/1978 | Treasarden | 273/1 GC |
| 4,169,592 | 10/1979 | Hall | 273/1 GC |
| 4,207,087 | 6/1980 | Morrison et al. | 273/1 E |
| 4,240,638 | 12/1980 | Morrison et al. | 273/138 A |

*Primary Examiner*—Vance Y. Hum
*Assistant Examiner*—Leo P. Picard
*Attorney, Agent, or Firm*—Mason, Kolehmainen, Rathburn & Wyss

[57] ABSTRACT

The game is characterized by a complicated and dangerous looking bomb-like housing which is equipped with a four-by-six keyboard under a hinged transparent cover. A pair of alternately flashing red incandescent lamps illuminate the keyboard. When the cover is opened, exposing the keyboard, the lamps may begin to flash or pulsate and the rate of flashing of the lamps may be increased and a fuse sound is produced which starts out at a relatively low pitch and gradually over a preselected time period increases in pitch to the point where it is obvious that an inevitable "blowup" will occur. The object of the game is to prevent the bomb from "exploding". If the bomb does explode, the fuse sound is terminated and a loud "boom" sound is produced which decays slowly and simulates the explosion of a bomb.

30 Claims, 5 Drawing Figures

MICROPROCESSOR CONTROLLED GAME

BACKGROUND OF THE INVENTION

1. Field of the Invention

This invention relates generally to games, and, more particularly, to an electronic keyboard game in which a preselected time period is established during which the keys of the keyboard must be depressed in a particular manner or pattern, audible and visible effects being employed during the preselected time period to distract the player and prevent him from concentrating on the keys which have been pressed. These audible and visual effects also being employed at the end of the preselected time period to indicate to the player or players that the game is over.

2. Brief Description of the Prior Art

Electronic keyboard games are known, for example, the electronic keyboard games disclosed in U.S. application Ser. Nos. 834,643 filed Sept. 19, 1977 and 865,898 filed Dec. 30, 1977, both of which are assigned to the assignee of the present invention. The former discloses an arrangement wherein the keys of a keyboard are associated with a tone or light, the device utilizing a microprocessor to generate a sequence of tones each associated with one of the key switches on the keyboard. If the participant correctly repeats the sequence the machine adds another entry to the sequence and plays the new sequences which must again be repeated by the participant. Also, electronically controlled games simulating the well known game of "battleship" are known wherein a microprocessor is employed to store the secret location of each player's battleship, and to provide a visible indication when the opposing player's keyboard selection of areas sinks the battleship.

While these electronic games provide a great deal of amusement, they have not generally provided a game wherein the player, or players, must work against a preselected time period during which the game must be completed, while audio and visual effects are produced which tend to distract the players from concentrating on the requirements of the game, particularly the requirement of remembering which keys of the keyboard have been pressed by either player during an extended sequence of play.

SUMMARY OF THE INVENTION

Accordingly, it is an object of the present invention to provide an electronic keyboard game in which a preselected time period is established during which the player or players must satisfy a predetermined sequence of events by pressing the keys on the keyboard in order to win the game.

It is another object of the present invention to provide a new and improved electronic keyboard game wherein audio and visual effects are produced during a preselected time period which tend to distract the player or players and prevent them from remembering which keys have been pressed, particularly as the end of the time period draws near.

It is another object of the present invention to provide a new and improved electronic keyboard game wherein a preselected time period is established and a microprocessor is employed to establish a predetermined key sequence which must be repeated by the player during the preselected time period.

It is another object of the present invention to provide a new and improved electronic keyboard game wherein a predetermined time period is established and a microprocessor is employed to preselect one key of the keyboard which the player must identify before the end of the preselected time period, the player being given clues in response to depressing keys of the keyboard which assist the player in locating the secretly designated key.

It is another object of the present invention to provide a new and improved electronic keyboard game wherein a predetermined time period is established and a microprocessor is employed to store the keys which are selected by either player and the sequence in which said keys are depressed, each player then trying to find the keys selected by the other player and their sequence, before the end of the predetermined time period.

In accordance with one aspect of the invention, there is provided a complicated and dangerous looking a bomb-like housing which is equipped with a 4×6" keyboard under a movable or hinged transparent cover. A pair of alternately flashing red lights are provided to illuminate the keyboard. When the cover is opened, thus exposing the keyboard, a "fuse" sound begins which starts out as a relatively low pitch and very gradually over a preselected time period increases in pitch to the point where it is obvious that an inevitable "blowup" will occur. At the same time, the light may begin flashing or the frequency of the flashing red lights may be increased, so that the players become more and more distracted by the rising audible and visible signals as the predetermined time period becomes used up.

In one embodiment of the game, the players take turns making keyboard entries and must remember all of the keys pressed by himself as well as each other player. If any key is pressed twice a sound simulating the explosion of the bomb is produced and the red lamps glow continually. On the other hand, if the entire group of keys are selected without a double selection of a key before the end of the preselected time period, the fuse sound gradually decays and the flashing light extinguishes, thus indicating that the bomb has been disarmed. The game is reset when the cover is closed and an arming switch returned to zero.

In an alternative single player mode, the microprocessor preselects one key at a time which the player must locate, the microprocessor providing an audible signal as each selected key is located by the player. The player must then remember which keys have been depressed and attempt to locate the entire sequence without depressing the same key twice. If the same key is pressed twice, the same explosive audio and visual effects are produced. On the other hand, if the player locates all of the keys in the predetermined sequence established by the microprocessor within the predetermined time period, the bomb is disarmed.

In a third mode of operation, the microprocessor secretly designates one key of the keyboard to be the only key which will defuse the bomb. The player is permitted to press five keys in an attempt to locate the "defuse" key. As each key is pressed, the microprocessor provides an audible signal if the defuse key is in a line within the "Quenn's move" from the key depressed by the player but no audible signal is given if the defuse is not in line with a "Queen's move." If the defuse key is pressed prior to the sixth turn, the bomb is exploded, i.e., the audio and visual effects described above are produced. Also, if the sixth key pressed by the player is not the defuse key, the bomb is also exploded. Furthermore, if the six keys are not pressed by the player within the predetermined time period, the bomb is exploded.

In accordance with a further embodiment of the invention, each of two players may select four keys which are memorized by the microprocessor in association with each player. The players then take turns pressing four buttons at a time to determine which keys are the ones coded by his opponent, an audible signal being given by the microprocessor when any coded key is pressed. In this embodiment, the bomb is not exploded by pressing a button that has already been pressed or inadvertently pressing a wrong button. On the contrary, the bomb is either defused before the time period expires or the bomb explodes.

BRIEF DESCRIPTION OF THE DRAWINGS

These and other objects and advantages of the present invention will become more apparent by reference to the following description taken in conjunction with the accompanying drawings, wherein.

DESCRIPTION OF THE PREFERRED EMBODIMENT

Figure 1:
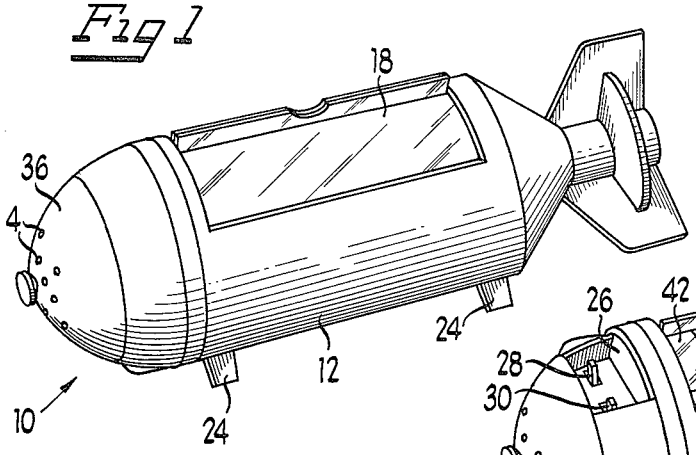
FIG. 1 is a perspective view of a preferred embodiment of the bomb-like device of the present invention.
Figure 2:
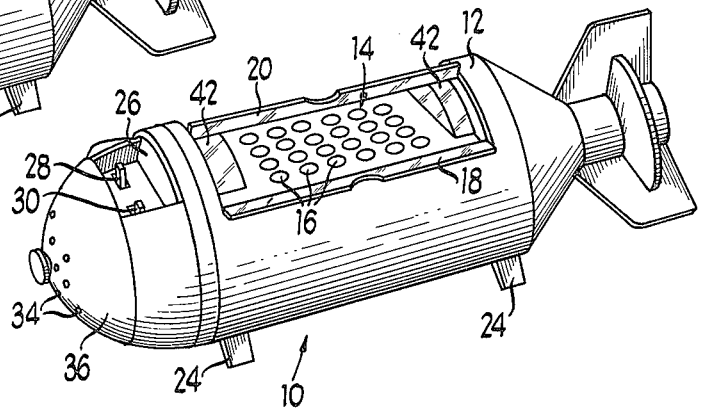
FIG. 2 is a view similar to FIG. 1 but showing one of the sliding doors of the bomb in an open position.

Referring now to the drawings, the present invention is therein illustrated as comprising a device indicated generally at 10 in the form of a complicated and dangerous looking bomb-like housing 12 within which is positioned a 4×6″ keyboard indicated generally at 14 and comprising four rows of six keys 16 each, the keyboard being enclosed by a pair of clear plastic sliding doors 18 and 20 which ride in the grooves 22 formed in the housing 12. The housing 12 is provided with legs 24 to maintain the keyboard in a horizontal position when the game is played.

Figure 4:
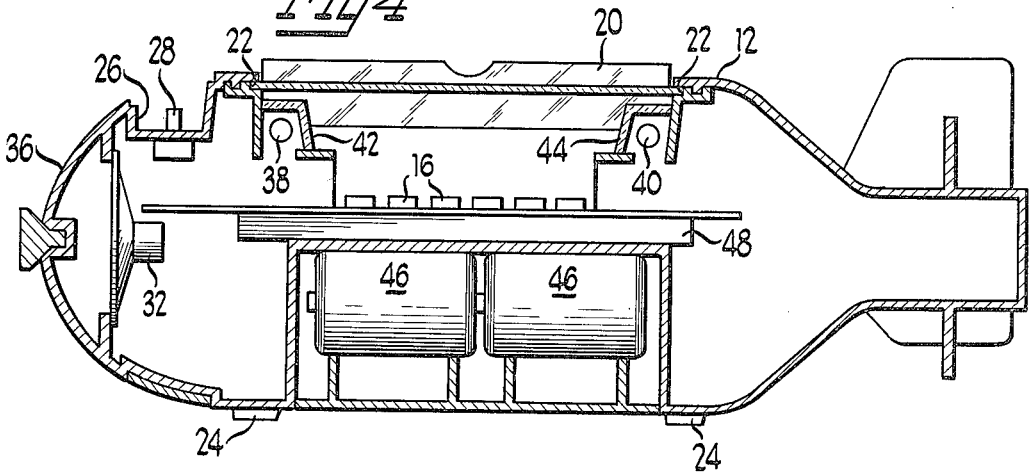
FIG. 4 is a sectional side elevational view taken along the centerline of the device of FIG. 1.

The housing 12 is provided with a forward open compartment 26 within which is positioned a game mode selector switch 28 and a fuse length selector switch 30. The game selector switch 28 is provided with four positions corresponding to the four different types or modes of game which may be played with the apparatus of the present invention. The fuse switch 30 is provided with an off or disarmed position, and three other positions corresponding to different preselected time periods during which the game must be played, these periods corresponding to a fuse time or fuse length of thirty, sixty and ninety seconds. A loudspeaker 32 is positioned in the nose portion of the housing 12 and perforations 34 are provided in the nose cone portion 36 of the housing to permit sounds from the loudspeaker to issue from the housing. A pair of red incandescent lamps 38 and 40 are positioned within a pair of red plastic light covers 42 and 44, respectively, which are positioned at either end of the keyboard 14 beneath the doors 18, 20. A series of four dry cell batteries 46 are positioned in the housing 12 beneath the keyboard 14, these batteries providing power for the microprocessor 48 (FIG. 4) as well as the lamps 38, 40.

Figure 3:
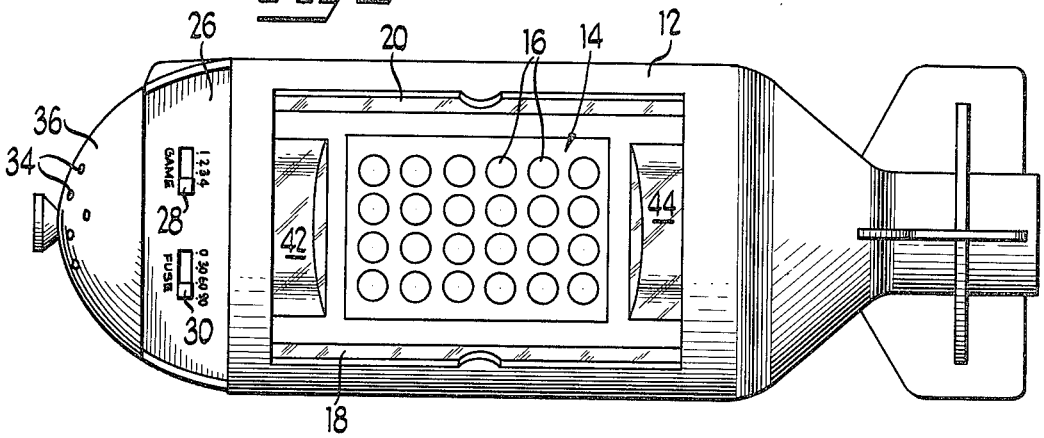
FIG. 3 is a top view of the device of FIG. 1.
Figure 5:
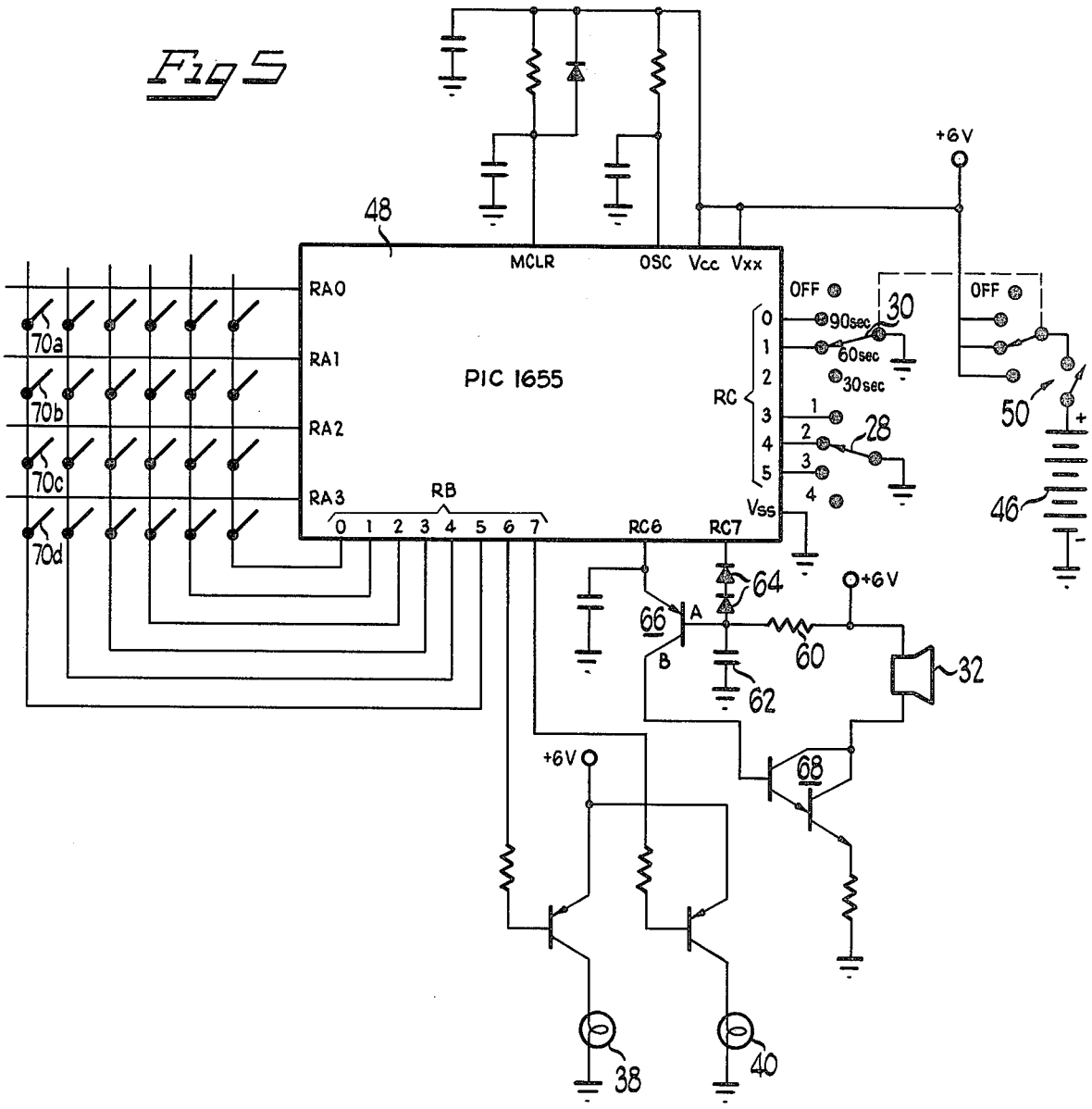
FIG. 5 is a detailed schematic diagram of the electronic circuitry of the game according to the present invention.

The doors 18, 20 are normally closed to the midposition shown in FIG. 1, in which position a microswitch 50 (FIG. 5) is open so that no power from the batteries 46 is supplied to the microprocessor 48. When the doors 18, 20 are moved to the open position shown in FIG. 3, the microswitch 50 is closed so that a preselected time period is started in accordance with the setting of the fuse length switch 30, this switch being moved to the zero position prior to selection of one of the three possible fuse lengths, i.e., the thirty, sixty or ninety second positions of the switch 30.

Several games may be played by the apparatus described thus far. Such games are selected by appropriately positioning the game switch 28 at one of the four positions indicated. Four games are described below corresponding to the four positions of the game switch.

GAME NO. 1

The clear plastic doors 18 and 20 act as an on-off switch so that when they are open the microswitch 50 is closed and the time period which has been preselected by the switch 30 is started. When this occurs, the lamps 38 and 40 may be alternately energized by the application of appropriate control signals to the terminals RB6 and RB7 of the microprocessor 48. Similarly, an audible signal, preferably a "tick-tick-tick" sound of the fuse is supplied to the loudspeaker 32 and the game begins immediately. Alternatively, the circuit could be modified slightly so that the switch 30 would operate as an off-on switch and as soon as the switch 30 is moved to the fuse length position, and before the doors 18 and 20 are opened, the lamps 38 and 40 may be alternately energized by the application of appropriate control signals to the terminals RB6 and RB7 of the microprocessor 48. Preferably, this microprocess is the model PIC-1655 which is a single-chip, large scle integrated circuit microprocessor manufactured by General Instrument Corporation. At the same time, an audible signal, preferably resembling the tick-tick-tick sound of a clock or timer, is supplied to the loudspeaker 32 to inform the players that the device 12 is on but the time period has not started. Then, when the doors 18, 20 are opened, the frequency of flashing of the lamps 38, 40 increases gradually over the predetermined time period set by switch 30 at a slow rate. At the same time, an audible signal, which may be termed a "fuse" sound correspondingly increases in frequency so that near the end of the preselected time period, the fuse sound is a high pitched scream which distracts the players and increases their anxiety level so that they cannot concentrate on the game. More particularly, an RC network comprising the resistor 60 and a capacitor 62 are connected between the plus 6 volt source and ground, the junction of these elements being connected to the base of a transistor 66. A pair of diodes 64 are connected from the control output terminal RC7 of the microprocessor 48 to the capacitor 62. When the device is turned on, and during the production of the fuse sound, the terminal RC7 is held low so that the capacitor 62 is discharged and the transistor 66 transmits the rising frequency signal at terminal RC6 to a Darlington amplifier 68 wherein it is amplified and passed to the loudspeaker 32. However, if the bomb is exploded, by any one of the conditions mentioned previously, the potential on the terminal RC7 is raised to a high level. When this occurs, the capacitor 62 charges up slowly through the resistor 60 so that a high intensity sound is produced in the loudspeaker 32 which gradually dies out. Preferably, the capacitor 62 and resistor 60 have a time constant of about ten seconds to provide a realistic "boom" sound when the bomb is exploded.

Each of the keys 16 controls the actuation of a push switch one terminal of which is sequentially scanned by output signals on the terminals RB0–RB5 of the microprocessor 48. More particularly, the first columm of four keys 16 control the switches 70*a*, 70*b*, 70*c* and 70*d*, one terminal of these switches being energized from the output terminal RB5 of the microprocessor 48. The other terminals of these switches are connected to the input terminals RA0, RA1, RA2 and RA3 of the microprocessor 48 so that the microprocessor can detect the depression of any of the keys 16 by the appropriately coded signal appearing on these input conductors.

Considering now the manner in which Game No. 1 may be played by two or more players, and assuming that the doors 18, 20 have been opened so that the above described audio and visual effects are produced with increasing frequency throughout the selected time period, the players are required to take turns making keyboard entries by depressing the keys 16. Each player must be careful to remember not only the keys that he has pressed but also the keys that his opponents have pressed.

During game play, the "fuse" sound continues to rise and the red lights 38, 40 flash faster and faster indicating that the bomb is getting closer to explosion. As the keys 16 are depressed by different players, the corresponding representations therefore are stored in the microprocessor 48 memory in accordance with conventional techniques. However, if any player presses a key that has already been pressed, it will immediately "explode" the bomb. This condition is indicated by causing the lamps 38, 40 to glow continuously by application of continuous control signals in the terminals RB6 and RB7 of the microprocessor. In addition, the "fuse" sound is discontinued and a sound simulating an explosion is supplied to the loudspeaker 32, as described heretofore. Similarly, if the players do not press an incorrect key but the preset fuse time is exceeded, the fuse sound is terminated and the explosion sound is turned on.

If, on the other hand, none of the players presses a wrong key, the player who presses the last key will defuse the bomb and win the game. This condition is indicated by causing the "fuse" sound to decay down to zero and also by de-energizing the lamps 38, 40.

GAME NO. 2

A single player mode may also be established by moving the selector switch 28 to the Game No. 2 position and appropriately setting the desired fuse length during which time period the player will have to complete the game. The doors 18, 20 are then opened and the above described fuse sound and increasing frequency flashing lights are started. In Game No. 2, the player begins the game by pressing different ones of the keys 16. The microprocessor 48 randomly selects one of the keys and produces an audible response in the loudspeaker 32 when this key is pressed by the player. This audible response may be a deep tone which may be heard over the rising frequency "fuse" sound or, in the alternative, the fuse sound may be interrupted during production of the audible beep tone by the microprocessor 48.

The random selection of one of the keys 16 may be made by the microprocessor 48 in any desired manner. For example, the moment when the player depresses the first one of the keys 16 may be employed to interrupt a high frequency loop and produce a random selection of a number by stopping the loop at that point. In the alternative, any other suitable means may be employed to randomly select the first key. Once the key is selected, the microprocessor then compares the keys pressed by the single player with the number representing the selected key and produces the above-described audible response when the selected key is pressed. After one preselected key is pressed, the microprocessor then selects another key randomly among those remaining which have not been selected and produces an audible response when this second key has been pressed by the player.

Once the player has pressed a key which produces an audible response, the player must never again press that key; otherwise, the bomb will explode and the above-described change in the audible and visible signals will be produced, as in Game No. 1. Play continues in this manner with the player pressing keys while making sure that as he comes to the various preselected keys he remembers their locations and never presses them again. Eventually, he is faced with the same problem as in Game No. 1, i.e., of looking for the one remaining key that has not been selected. Pressing this key will defuse the bomb and the player wins provided he has found all of the keys during the preselected fuse time. At any time during the play of the game, if he presses a key which has previously been selected, he will "explode" the bomb. In Game No. 2, it may be determined that twenty-four keys are much too difficult to remember and therefore the keyboard 14 may be limited to a $3\times4''$ array of twelve keys. This may conveniently be done by programming the microprocessor 48 so that only twelve of the twenty-four keys 16 are scanned by the output lines RB0–RB3 and the input lines RA1–RA3.

GAME NO. 3

In Game No. 3, the microprocessor randomly and secretly selects and stores one key in the keyboard 14 of twenty-four keys 16, the selected key being the only key which will defuse the bomb. Again the random selection of one of the keys in the keyboard 14 may be accomplished in any desired manner, as for example, in response to the moment at which the player presses the first key during the game. In Game No. 3, the player may press a given number of keys, such as five keys, to get clues as to the location of the "defuse". However, the sixth key that he presses must be the "defuse" key in order to defuse the bomb. If he does not press the "defuse" key on the sixth turn, the bomb will explode. Also, if he presses the "defuse" key prior to the sixth turn, he will also "explode" the bomb. In this connection, it will be understood that in each of the games described thus far opening of the doors 18, 20 causes the "fuse" sound to be initiated and start rising in frequency, the flashing lights 38, 40 also being controlled to flash increasingly fast during the preselected fuse length time period. In Game No. 3, the player, as he plays the game, must very carefully use the information that the microprocessor gives him to logically deduce the location of the "defuse" key. The information which the microprocessor 48 gives him is (1) if the "defuse" key is not in line with the horizontal, vertical and diagonal lines which intersect at the key that the player has pressed, i.e., is not in line with a so-called "Queen's move" in the game of chess, then no audible response is produced by the microprocessor, or (2) an audible beep tone is produced if the "defuse" key is in line with a "Queen's move" from the key which the player has depressed, i.e., the "defuse" key is along a horizontal, vertical or diagonal line which intersects at the key the player has pressed. The microprocessor 48 may use any suitable programming for establishing this "Queen's move" relationship to each key as the player depresses it, such programming being conventional in computerized chess games, and the like.

GAME NO. 4

The start of Game No. 4 is the same as the other games described above, i.e., the mode selector switch 28 is moved to Game No. 4 and the fuse length is set to the thirty, sixty or ninety second position by the switch 30. As soon as this occurs, the lamps 38, 40 may flash slowly and be accompanied by a tick-tick-tick sound which is supplied to the loudspeaker 32 from the microprocessor 48. However, when the doors 18, 20 are opened, the "fuse" sound does not start and each player is required to code the keyboard for his opponent with four keys selected at random and coded in a specific sequence. This code sequence then becomes the problem for his opponent. The procedure for setting up this problem is that player A presses four buttons on the keyboard 14 without player B seeing which ones or in what order they were pressed. Then player B does the same thing with four buttons in a sequence of his choice. The microprocessor 48 stores the information for each player, for example, that player A has pressed buttons 1, 5, 7 and 9, in that order and also stores that player B pressed buttons 12, 16, 4 and 7 in that order. When player B presses the last button in his sequence, the "fuse" sound comes on and the game begins.

The players take turns pressing four buttons at a time to determine which buttons are his coded ones. As each of these coded buttons is pressed, an audible response is produced by the microprocessor 48, this response being in the form of a beep tone which is either audible above the "fuse" sound or the fuse sound is interrupted for it.

The game continues with each player alternately pressing four buttons in an attempt to determine the four buttons which were coded by the other player. When a player has located the four correct buttons, he must now find the sequence in which the buttons must be pressed to defuse the bomb. The game continues therefore with each player pressing his four known buttons in various combinations to be the first one to defuse the bomb.

In Game No. 4, it is obviously important that each player go exactly in his turn so that the microprocessor 48 can keep track of the two groups of four hidden buttons associated with the proper players. In order to facilitate this, the microprocessor 48 may be programmed to illuminate either the lamp 38 or the lamp 40 to indicate whether player A or player B is to press a series of four buttons. The lamps 38, 40 may continue to be energized by the rising frequency signal corresponding to the "fuse" sound, but only one of these lamps will be illuminated at a time to indicate which player is to take a turn.

The object of Game No. 4 is to be the first player to defuse the bomb. Of course, if neither player defuses the bomb before the preset fuse time expires, both players lose. In this game the players do not set the bomb off by pressing a button that has already been pressed or inadvertently pressing the wrong button, but instead either defuse the bomb before the time is out or the bomb explodes. When the bomb explodes the change in audible and visual signals is produced in the same manner as described in detail heretofore in connection with Game No. 1.

The foregoing detailed description has been given for clearness of understanding only and is intended to be exemplary of the invention while not limiting the invention to the exact embodiment shown. Obviously many modifications and variations are possible in light of the above teachings and it is to be understood that within the scope of the appended claims, the invention may be practiced otherwise than specifically hereinbefore described.

What is claimed and desired to be secured by U.S. Letters Patent is:

1. In an electronic keyboard game, the combination of, means for establishing a predetermined time period during which a game is to be played, said time period establishing means including means for determining the expiration of said time period, means for generating a sensorially perceptible event at the end of said time period, a plurality of keys arranged in a keyboard of predetermined configuration for activation by the players one at a time, means for storing representations corresponding to each of said keys as they are actuated by the players, and means responsive to a second actuation of one of said keys by one of the players for generating said sensorially perceptible event prior to the expiration of said predetermined time period, said game further including a housing for said keyboard, a cover movably mounted in said housing and normally covering said keyboard, and means responsive to movement of said cover to an open position for initiating said predetermined time period.

2. The electronic keyboard game of claim 1, wherein said sensorially perceptible event is an audible event simulating the detonation of a bomb.

3. The electronic keyboard game of claim 1, which includes a source of flashing light, and means for increasing the frequency of light flashes from said source during said predetermined time period.

4. The electronic keyboard game of claim 3, wherein said sensorially perceptible event comprises means for causing said flashing light source to emit light continuously.

5. The electronic keyboard game of claim 1, wherein said housing simulates a bomb and said predetermined time period represents a fuse length prior to explosion of the bomb.

6. The electronic keyboard game of claim 5, which includes means for varying said predetermined time period.

7. The electronic keyboard game of claim 5, which includes means for generating an audible signal of gradually increasing amplitude during said predetermined time period, said audible signal simulating the burning of a fuse.

8. The electronic keyboard game of claim 7, wherein said sensorially perceptible event generating means includes means for generating an audible sound simulating the detonation of a bomb.

9. The electronic keyboard game of claim 1, which includes means for varying said predetermined time period.

10. The electronic keyboard game of claim 1, which includes means responsive to the selection of all of said keys one at a time and prior to the double selection of any one key for disabling said sensorially perceptible event generating means.

11. The electronic keyboard game of claim 1, which includes means for generating an audible signal of gradually increasing amplitude during said predetermined time period, and means for discontinuing said audible signal at the end of said predetermined time period.

12. In an electronic keyboard game, the combination of, means for establishing a predetermined time period during which a game is to be played, means for determining the end of said predetermined time period, means for generating a sensorially perceptible event at the end of said time period, a plurality of keys arranged in a keyboard of predetermined configuration for activation by a player one at a time, means for randomly sequentially selecting different ones of said keys as a target key, means for developing an audible signal in response to the initial actuation of a target key by a player, and means responsive to a second actuation of a target key by a player for generating said sensorially perceptible event prior to the expiration of said predetermined time period.

13. The electronic keyboard game of claim 12, which includes means responsive to the single actuation of all of said target keys in said sequence prior to the double actuation of any one thereof for disabling said sensorially perceptible event generating means.

14. In an electronic keyboard game, the combination of, means for establishing a predetermined time period during which a game is to be played, means for generating light flashes the frequency of occurrence of which increases during said time period, a plurality of keys arranged in a keyboard of predetermined configuration for actuation by a player one at a time, means for storing representations corresponding to each of said keys as they are actuated by a player, and means responsive to a second actuation of one of said keys by a player prior to the expiration of said time period for generating a sensorially perceptible event including a continuous light in place of said flashes.

15. The electronic keyboard game of claim 14, which includes means responsive to the single actuation of each of said keys prior to double actuation of any one thereof and prior to the expiration of said time period for discontinuing generation of said light flashes.

16. The electronic keyboard game of claim 14, wherein the frequency of said light flashes at the end of said time period is sufficiently high that said light flashes appear to be continuous due to the persistence of vision of the player.

17. In an electronic keyboard game, the combination of a housing constructed to simulate a bomb, a keyboard positioned within said housing, closure means on said housing and movable from a first position which prevents access to said keyboard to a second position which permits access to said keyboard, means for selecting one of a number of different time periods during which the game is to be played, means controlled by said time period selection means for producing a ticking sound simulating an armed bomb, and means responsive to movement of said closure means from said first position to said second position for terminating said ticking sound and producing a sound which simulates the burning of a fuse and indicates the start of said selected time period.

18. The combination of claim 17, which includes means for generating a slowly flashing red light when said ticking sound is produced.

19. The combination of claim 18, wherein said means for generating a slowly flashing red light includes a lamp bulb positioned within said housing and including means for making said bulb visible through said closure means when in said first position.

20. The combination of claim 17, including means for causing said fuse sound to increase in frequency during the selected time period.

21. The combination of claim 17, which includes means for storing representations corresponding to each of said keys as they are actuated by a player, and means responsive to a second actuation of one of said keys by a player prior to the expiration of said selected time period for terminating said fuse sound and producing a sound simulating the explosion of a bomb.

22. The combination of claim 17, which includes means for selecting one of the keys of said keyboard as a defuse key, means for selecting a predetermined number of other keys, and means for terminating said fuse sound and producing a sound simulating the explosion of a bomb in the event that said defuse key is pressed before a predetermined number of other keys have been pressed.

23. The combination of claim 22, which includes means for determining whether said defuse key lies along horizontal, vertical, or diagonal lines which intersect at said depressed key and means operative when any one of the keys of said keyboard other than said defuse key is pressed to produce an audible signal in the event that said defuse key lies along horizontal, vertical or diagonal lines which intersect at said depressed key.

24. The combination of claim 17, which includes means for selecting one of the keys of said keyboard as a defuse key, and means for terminating said fuse sound and producing a sound simulating the explosion of a bomb in the event that said defuse key is not pressed after a predetermined number of other keys have been pressed.

25. The combination of claim 24, including means for determining the expiration of a time period wherein said explosion sound is also produced in the event that said defuse key is not pressed prior to the expiration of said selected time period.

26. The combination of claim 25, wherein said explosion sound is also produced in the event that said defuse key is not pressed prior to the expiration of said selected time period.

27. The combination of claim 17, which includes means for preselecting one of the keys of said keyboard as a defuse key, means for determining the end of a predetermined time period, and means for producing a sound simulating the explosion of a bomb in the event said defuse key is not pressed prior to the expiration of said selected time period.

28. The combination of claim 17, which indcludes means for selecting one of the keys of said keyboard as a defuse key, means for determining whether said defuse key lies along horizontal, vertical, or diagonal lines which intersect at said depressed key, and means operative when any one of the keys of said keyboard other than said defuse key is pressed to produce an audible signal in the event that said defuse key lies along horizontal, vertical or diagonal lines which intersect at said depressed key.

29. The combination of claim 17, which includes means for storing representations corresponding to different groups of keys selected by the players, and means for delaying production of said fuse sound until after all of said groups of keys have been selected by the players.

30. The combination of claim 29, which includes means for producing a sound simulating the explosion of a bomb in the event that the keys selected by each player are not located by the opponent within said selected time period.

* * * * *